US009896931B2

(12) United States Patent
Chiang

(10) Patent No.: US 9,896,931 B2
(45) Date of Patent: Feb. 20, 2018

(54) CUTTING TOOL HOLDING DEVICE

(71) Applicant: EVERPADS CO., LTD., Taichung (TW)

(72) Inventor: Chun-Li Chiang, Taichung (TW)

(73) Assignee: EVERPADS CO., LTD., Taichung (TW)

( * ) Notice: Subject to any disclaimer, the term of this patent is extended or adjusted under 35 U.S.C. 154(b) by 179 days.

(21) Appl. No.: 14/919,711

(22) Filed: Oct. 21, 2015

(65) Prior Publication Data

US 2016/0281502 A1 Sep. 29, 2016

(30) Foreign Application Priority Data

Mar. 27, 2015 (CN) ..... 2015 2 0179252 U

(51) Int. Cl.
*E21C 35/18* (2006.01)

(52) U.S. Cl.
CPC ..... *E21C 35/18* (2013.01)

(58) Field of Classification Search
CPC .. E21C 35/18; E21C 35/19; E21C 2035/1826; E21C 2035/191
See application file for complete search history.

(56) References Cited

U.S. PATENT DOCUMENTS 5,114,264 A * 5/1992 Barlow ..... B23B 31/006 403/323
5,125,720 A * 6/1992 Salani ..... E21C 35/19 299/107
5,607,206 A * 3/1997 Siddle ..... E21C 35/19 299/102
7,537,288 B2 * 5/2009 Chiang ..... B28D 1/188 299/102
2005/0150666 A1 * 7/2005 Holl et al. ..... E21C 35/18 299/108
2012/0001475 A1 * 1/2012 Dubay ..... E21C 25/10 299/108

* cited by examiner

*Primary Examiner* — John Kreck
(74) *Attorney, Agent, or Firm* — CKC & Partners Co., Ltd.

(57) ABSTRACT

A cutting tool holding device for holding a cutting tool is provided. The cutting tool holding device includes a base, a holder, and a fastening member. The base includes a rabbet, an angular receiving hole, and a positioning hole. The holder includes a main body and a tool receiving corner post. The main body includes an engaging portion which is detachably engaged into the rabbet. The tool receiving corner post extending projects from the main body and is correspondingly set into the angular receiving hole, wherein a position limiting groove is formed on the tool receiving corner post corresponded with the positioning hole. The fastening member is fastened in the positioning hole and pressed against the position limiting groove.

14 Claims, 13 Drawing Sheets

CUTTING TOOL HOLDING DEVICE

RELATED APPLICATIONS

This application claims priority to China Application Serial Number 201520179252.5, filed Mar. 27, 2015, which is herein incorporated by reference.

BACKGROUND

Technical Field

The present disclosure relates to a holding device. More particularly, the present disclosure relates to a cutting tool holding device.

Description of Related Art

A cutting tool holding device is used to hold a cutting tool and configured to be attached to a road planer for cutting, mining, excavating the ground or applying a surface roughness treatment to a road.

Conventionally, the cutting tool holding device includes a base and a cutting tool holder for receiving a cutting, tool. The base is fixed on a peripheral surface of a working member (such as a roller) of a machinery (such as a road planer), and the cutting tool holder is engaged with the base by some fastening members. The cutting tool received in the cutting tool holder is mounted along a tangent of the base for facilitating the excavating or cutting operations applied to the ground. In the working process of the aforementioned machinery, an excavating operation is first applied to a processed material (such as concrete asphalt over a road) by the cutting tool; as the roller rotates, a cutting operation is then applied to the ground by the cutting tool so as to destroy the processed material.

In general, the processed material is solid and stiff, and a reaction force generated from the processed material during the working process will exert on the cutting tool. Thus the cutting tool working on it only has a rather limited lifetime. Furthermore, when the base and the cutting tool holder are not firmly engaged, serious damages caused by the reaction force occur in the cutting tool holder and the base. As a result, the cutting tool holder and the base are also in need of the frequent replacement. Consequently, the maintenance cost of the cutting tool holding device is high in the art.

Therefore, it is important to reinforce the engagement between the base and the cutting tool holder and increase a load value of the base and the load value of the cutting tool holder for the reaction force of the base and the cutting tool holder for prolonging the life span of the cutting tool holding device so as to reduce the maintenance cost thereof.

SUMMARY

According to one aspect of the present disclosure, a cutting tool holding device for holding a cutting tool is provided. The cutting tool holding device includes a base, a holder, and a fastening member. The base includes a front rake wall, a back rake wall, and a positioning hole. The front rake wall has a rabbet, and the back rake wall connected to the front rake wall has an angular receiving hole. The positioning hole is penetrated one end of the base and communicated with the angular receiving hole. The holder is mounted on the base for receiving the cutting tool, wherein the holder includes a main body and a tool receiving corner post. The main body includes a first abutting portion and a second abutting portion. The first abutting portion has a first abutting surface and an engaging portion, wherein the first abutting surface is abutted against the front rake wall, and the engaging portion is detachably engaged into the rabbet. The second abutting portion has a second abutting surface abutted against the back rake wall. The tool receiving corner post extending projects from the main body and is correspondingly set into the angular receiving hole, wherein a position limiting groove is formed on the tool receiving corner post corresponded with the positioning hole. The fastening member is fastened in the positioning hole and pressed against the position limiting groove.

According to another aspect of the present disclosure, a cutting tool holding device for holding a cutting tool is provided. The cutting tool holding device includes a base, a holder, a fastening member, and a draw bolt member. The base includes a front rake wall, a back rake wall, and a positioning hole. The front rake wall has a rabbet; and the back rake wall connected to the front rake wall has an angular receiving hole. The positioning hole is penetrated one end of the base and communicated with the angular receiving hole. The holder is mounted on the base for receiving the cutting tool, wherein the holder includes a main body and a tool receiving corner post. The main body includes a first abutting portion and a second abutting portion. The first abutting portion has a first abutting surface and an engaging portion, wherein the first abutting surface is abutted against the front rake wall, and the engaging portion is detachably engaged into the rabbet. The second abutting portion has a second abutting, surface abutted against the back rake wall. The tool receiving corner post extending projects from the main body and is correspondingly set into the angular receiving hole, wherein a position limiting groove is formed on the tool receiving corner post corresponded with the positioning hole. The fastening member is movably disposed in the positioning hole and pressed against the position limiting groove, wherein a threaded hole is formed in one end of the fastening member, and a sectional area of the fastening member gradually changes along an extending direction of the fastening member. The draw bolt member is limitedly disposed in the positioning hole, wherein the draw bolt member has a threading portion for screwing into the threaded hole, whereby the draw bolt member draws the fastening member moving in the positioning hole to change a pressing extent between the fastening member and the position limiting groove.

BRIEF DESCRIPTION OF THE DRAWINGS

The present disclosure can be more fully understood by reading the following detailed description of the embodiment, with reference made to the accompanying drawings as follows.

DETAILED DESCRIPTION

Figure 1:
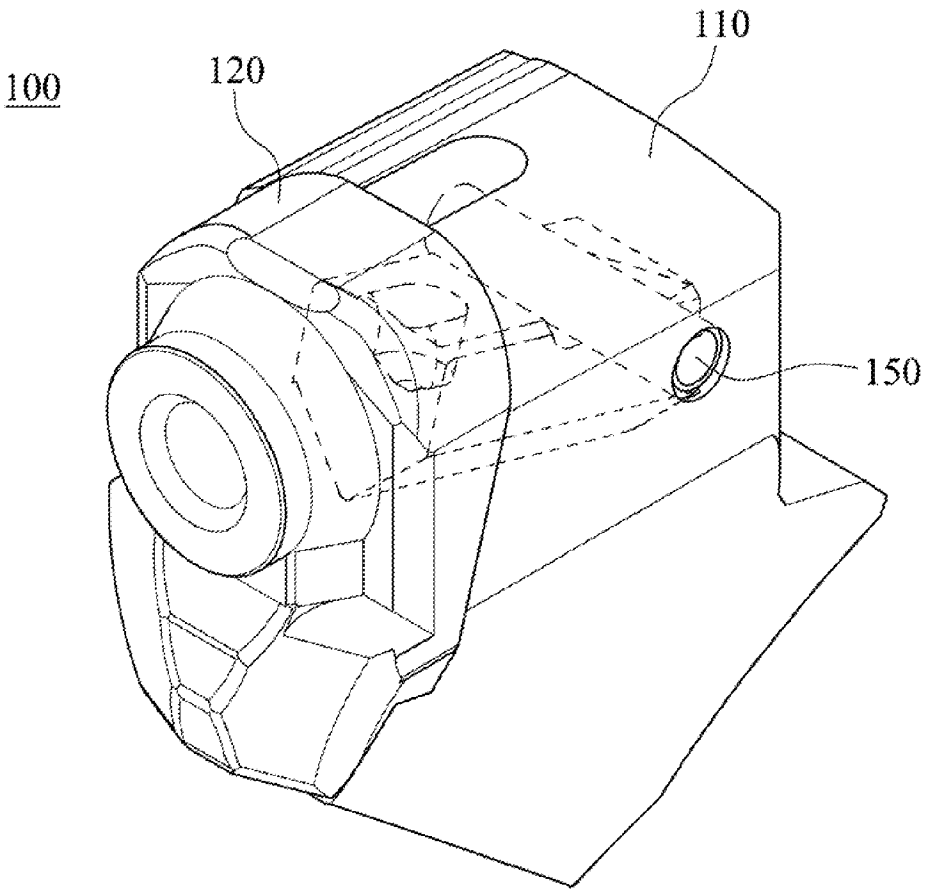
FIG. 1 is a perspective view of a cutting tool holding device according to the first embodiment of the present disclosure.
Figure 2:
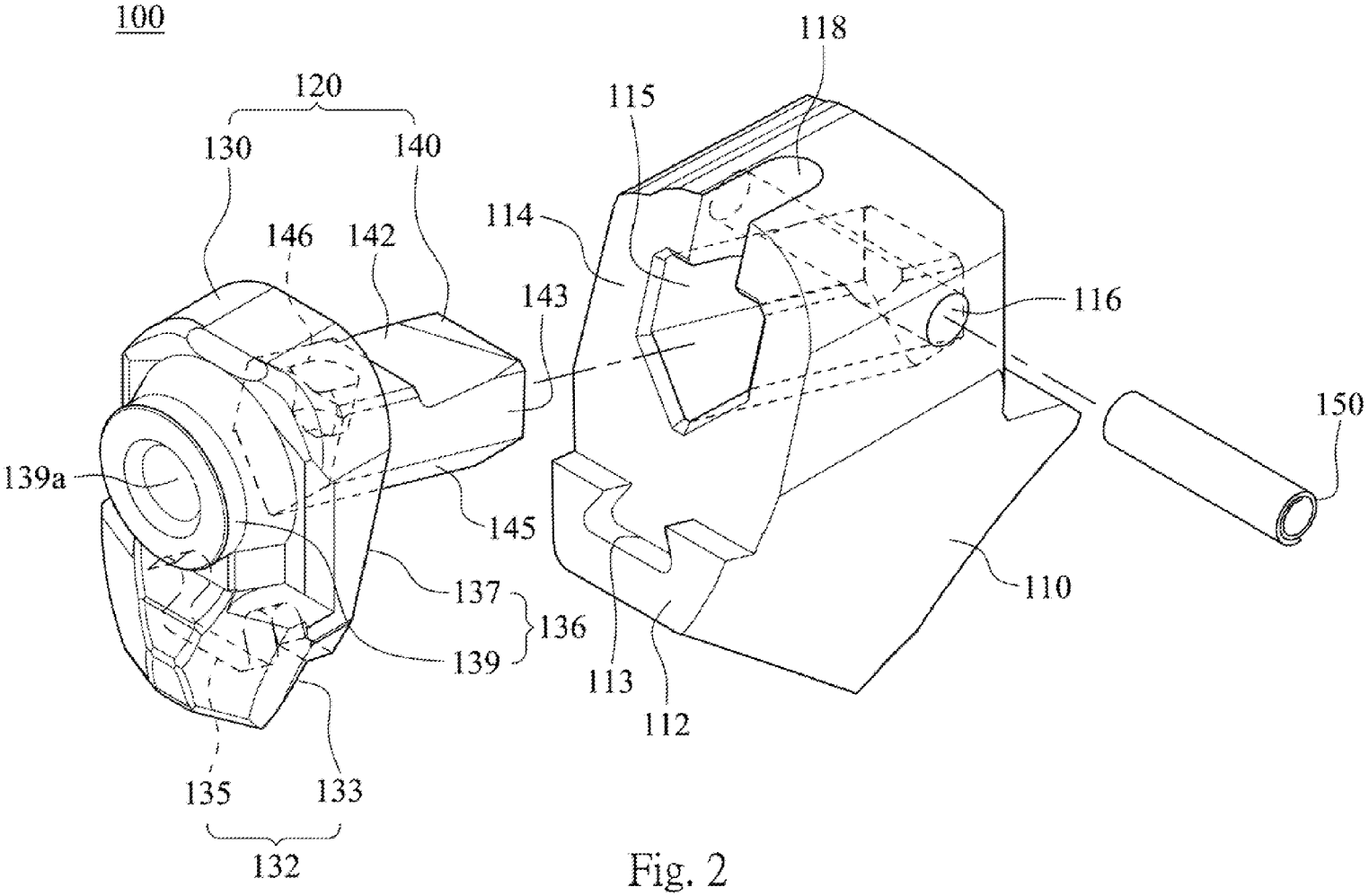
FIG. 2 is an exploded view of the cutting tool holding device shown in FIG. 1.
Figure 6:
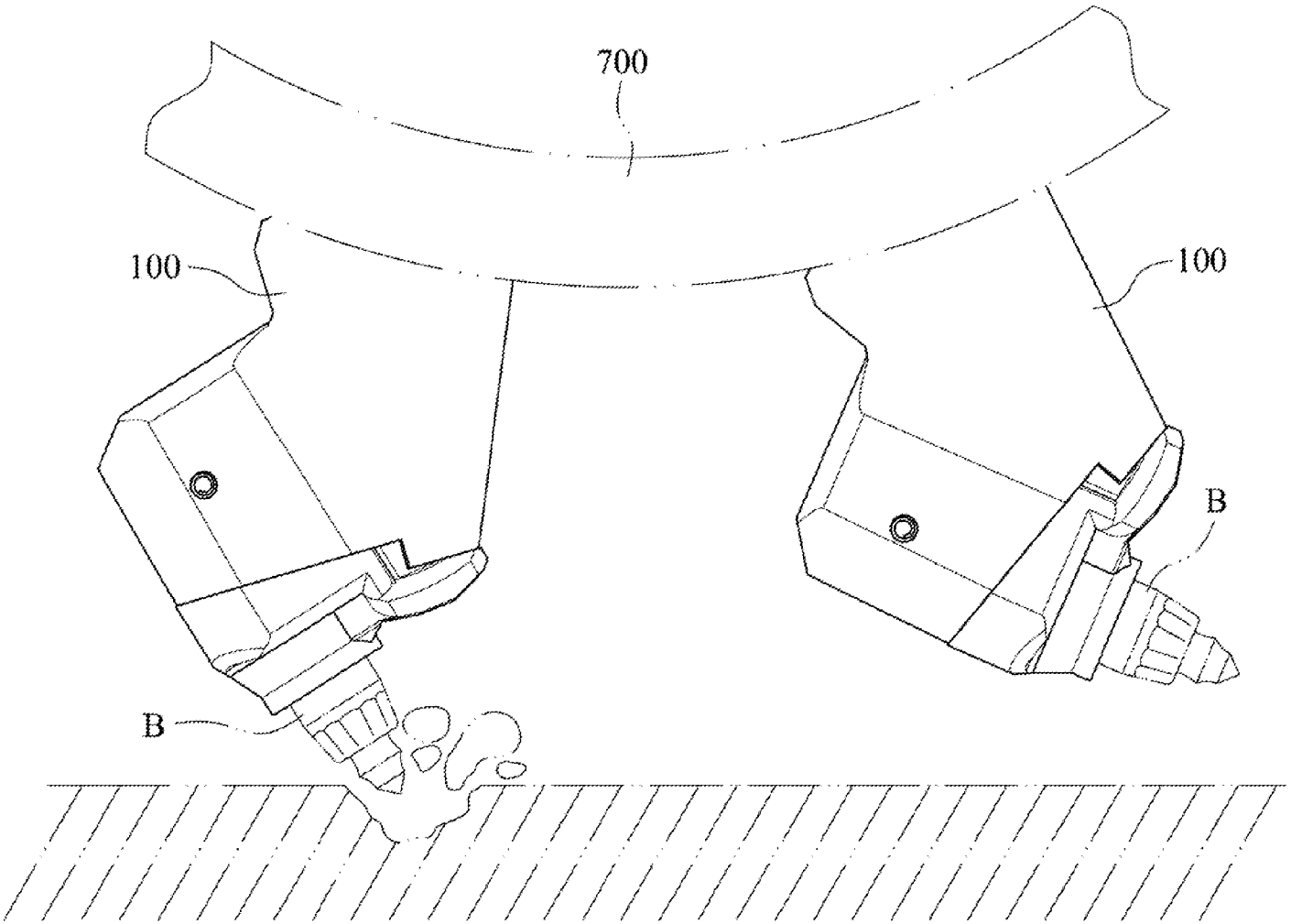
FIG. 6 is an operating schematic view of the cutting tool holding device shown in FIG. 1.

FIG. 1 is a perspective view of a cutting tool holding device 100 according to the first embodiment of the present disclosure. FIG. 2 is an exploded view of the cutting tool holding device 100 shown in FIG. 1. In FIGS. 1 and 2, the cutting tool holding device 100 is for holding a cutting tool B (as shown in FIG. 6). The cutting tool holding device 100 includes a base 110, a holder 120, and a fastening member 150. The holder 120 is mounted on the base 110, and the fastening member 150 is disposed in the base 110.

The base 110 includes a front rake wall 112, a back rake wall 114, a positioning hole 116, and a first pushing hole 118. The front rake wall 112 is connected to the back rake wall 114, wherein the front rake wall 112 has a rabbet 113, and the front rake wall 112 has an angular receiving hole 115. The angular receiving hole 115 has a central axis (not shown), wherein the central axis of the angular receiving hole 115 is paralleled to an extending direction of the rabbet 113. The positioning hole 116 is penetrated one end of the base 110 and communicated with the angular receiving hole 115. The positioning hole 116 has the central axis (not shown), wherein the central axis of the positioning hole 116 is perpendicular to an extending direction of the angular receiving hole 115. The first pushing hole 118 is formed on the other side of the base 110 and communicated with the angular receiving hole 115.

The holder 120 is mounted on the base 110 for receiving the cutting tool B, wherein the holder 120 includes a main body 130 and a tool receiving corner post 140.

The main body 130 includes a first abutting portion 132 and a second abutting portion 136. The first abutting portion 132 has a first abutting surface 133 and an engaging portion 135, wherein the first abutting surface 133 is abutted against the front rake wall 112, and the engaging portion 135 is detachably engaged into the rabbet 113. The second abutting portion 136 has a second abutting surface 137 and a mounting surface 139. The second abutting surface 137 is a flat surface and is fitting abutted against the back rake wall 114. The mounting surface 139 is located on the other side of the second abutting surface 137, and the mounting surface 139 has a holding hole 139*a* for holding the cutting tool B (as shown in FIG. 6).

The tool receiving corner post 140 extending projects from the main body 130 and is correspondingly set into the angular receiving hole 115. A shape of the angular receiving hole 115 is complementary to the shape of the tool receiving corner post 140 so that the tool receiving corner post 140 does not move relative to the base 110 after setting into the angular receiving hole 115. A position limiting groove 142 is formed on the tool receiving corner post 140 corresponded with the positioning hole 116. A second pushing hole 146 is formed on the tool receiving corner post 140 near the main body 130, wherein the second pushing hole 146 is communicated with the holding hole 139*a* and the first pushing hole 118 for removing the cutting tool B.

The fastening member 150 is a C-shaped elastic tube. The fastening member 150 is fastened in the positioning hole 116 of the base 110 by an expanding elasticity thereof and pressed against the position limiting groove 142 of the tool receiving corner post 140.

Figure 4:
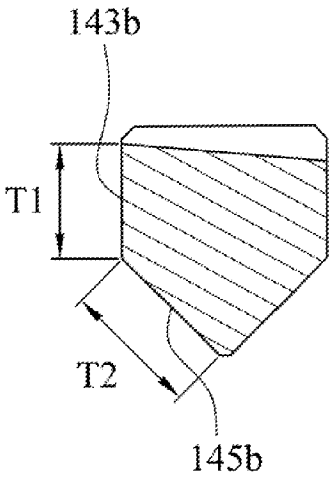
FIG. 4 is a partial cross-sectional view of the holder taken along line 4-4 of FIG. 3.
Figure 3:
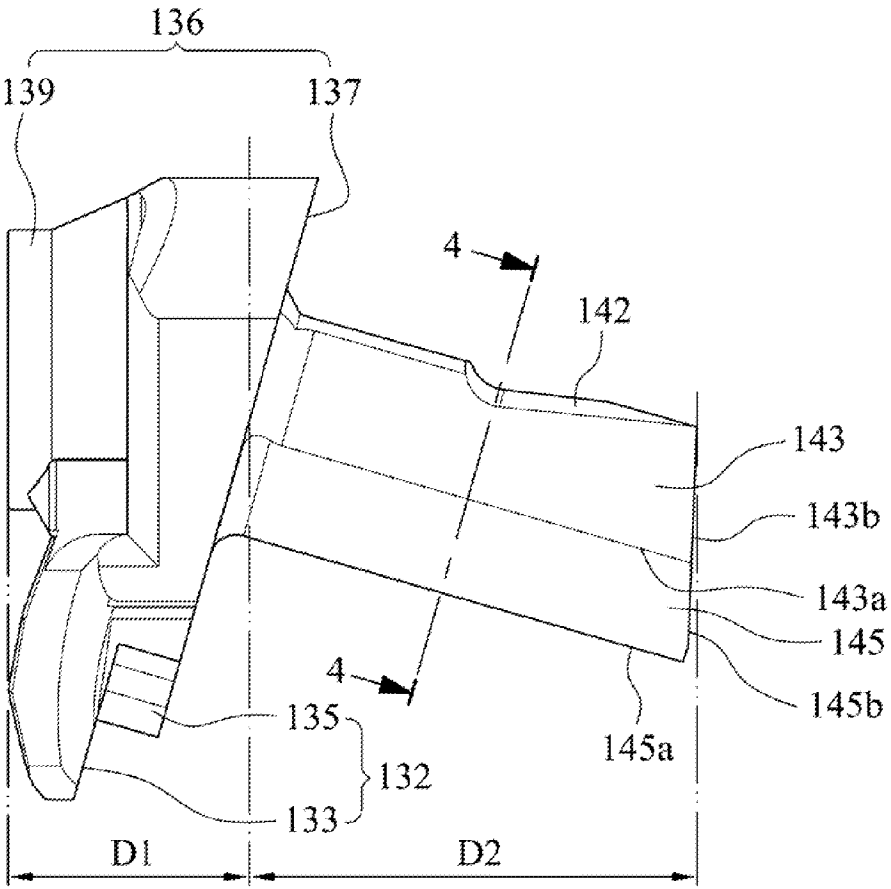
FIG. 3 is a side view of a holder shown in FIG. 1.

FIG. 3 is a side view of the holder 120 shown in FIG. 1. FIG. 4 is a partial cross-sectional view of the holder 120 taken along line 4-4 of FIG. 3. In FIGS. 3 and 4, the holder 120 has the central axis (not shown), and a thickness D1 of the main body 130 along the central axis is less than the thickness D2 of the tool receiving corner post 140 along the central axis. The tool receiving corner post 140 has at least two first side surfaces 143 and at least two second side surfaces 145. The first side surfaces 143 and the second side surfaces 145 are rectangular. Each of the first side surfaces 143 has a first adjacent side 143*a* and a first nonadjacent side 143*b*. Each of the second side surfaces 145 has a second adjacent side 145*a* and a second nonadjacent side 145*b*. Two first side surfaces 143 are paralleled to each other. Each of the second adjacent sides 145*a* on one side of the second side surface 145 adjoins the first adjacent side 143*a*, and the second adjacent sides 145*a* on the other side of the second side surfaces 145 approaches to each other to form a square pyramid. Furthermore, two second side surfaces 145 of the tool receiving corner post 140 are abutted against the base 110 along a force central axis (not shown) of the cutting tool holding device 100. A length T1 of the first nonadjacent side 143*b* is less than the length T2 of the second nonadjacent side 145*b*. An area of the second side surface 145 is greater than the area of the first side surface 143, and the second side surface 145 is abutted against the base 110 along the force central axis (not shown) of the cutting tool holding device 100. Therefore, the greater area of the second side surface 145 can enhance a stability of the engagement between the base 110 and the holder 120.

Figure 5:
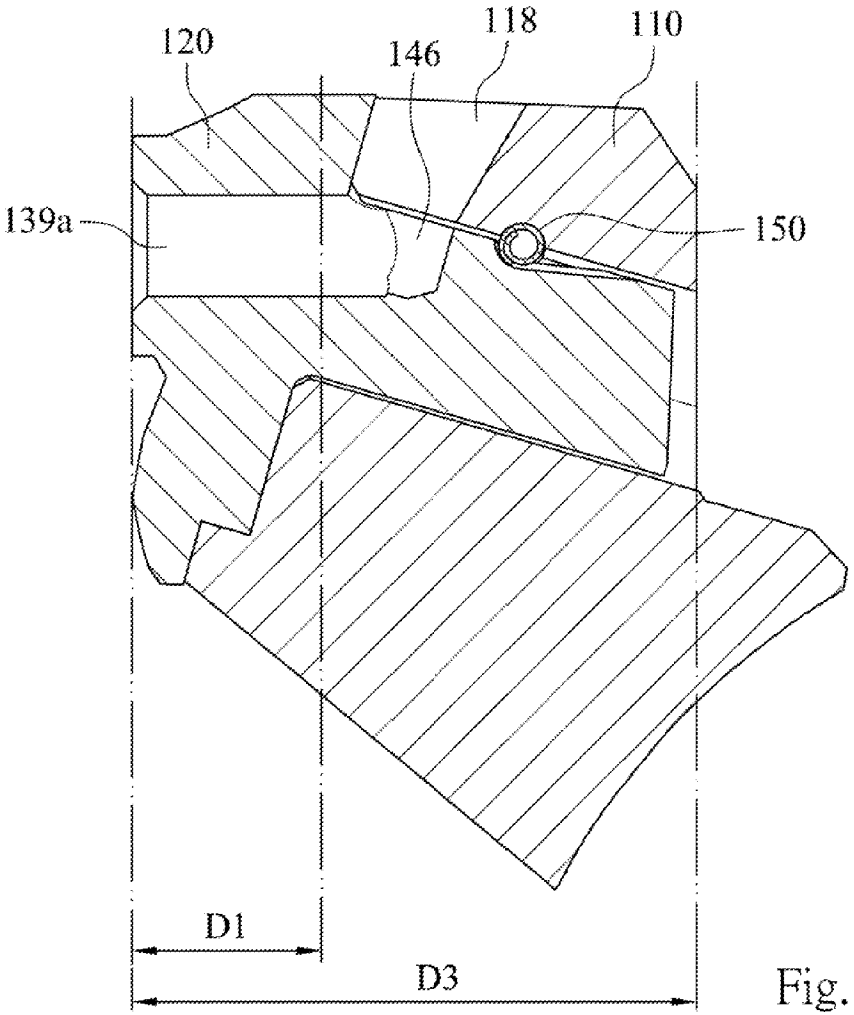
FIG. 5 is a cross-sectional view of the cutting tool holding device of FIG. 1.

FIG. 5 is a cross-sectional view of the cutting tool holding device 100 of FIG. 1. The thickness D1 of the main body 130 along the central axis is less than the thickness D2 of the tool receiving corner post 140 along the central axis. After the holder 120 is mounted on the base 110, a ratio of the thickness D1 of the main body 130 to the thickness D3 of the cutting tool holding device 100 is ⅓. Because the cutting tool holding device 100 of the present disclosure is reduced the thickness of the holder 120 projecting from the base 110 so that the center of gravity of the cutting tool holding device 100 is shifted to the base 110, a more stable structure in the cutting tool holding device 100, to avoid a leverage effect and reduce the reaction force. Therefore, the holder 120 does not shake and rupture so easy.

According to the foregoing embodiment of the disclosure, the cutting tool holding device 100 has advantages as follows. First, the shape complementation between the angular receiving hole 115 and the tool receiving corner post 140 can avoid a rotation of the holder 120. Second, the engagement between the engaging portion 135 and the rabbet 113, the design of the second abutting surface 137 of the main body 130 and the second side surface 145 of the tool receiving corner post 140, and the fix of the holder 120 on the base 110 by the fastening member 150 can enhance the stability of the engagement between the base 110 and the holder 120 and increase a load value of the base 110 and the load value of the holder 120 for the reaction force. More-over, the reduced thickness of the main body 130 of the holder 120 can decrease the reaction force generated from a processed material acting on the cutting tool holding device 100. Therefore, the life span of the base 110 and the holder 120 can be prolonged, and the maintenance cost can be reduced.

FIG. 6 is an operating schematic view of the cutting tool holding device 100 shown in FIG. 1. In FIG. 6, the cutting tool holding device 100 is fixed on a peripheral surface of a machinery 700 that is treated a roughness of the road. The cutting tool holding device 100 is received the cutting tool B, and the machinery 700 is applied to the processed material (such as the road) by the cutting tool B. The cutting tool holding device 100 can avoid the rotation of the holder 120, reduce the ratio of the thickness of the main body 130 of the holder 120, and enhance the stability of the engagement between the base 110 and the holder 120. Therefore, the design of the present disclosure can improve the load value of the base 110 and the load value of the holder 120 for the reaction force. The life span of the base 110 and the holder 120 can be prolonged, and the maintenance cost can be reduced. The components of the cutting tool holding device 100 (such as the base 110 and the holder 120) do not need to replace when replacing the cutting tool B, hence the maintenance cost can be further reduced.

Figure 7:
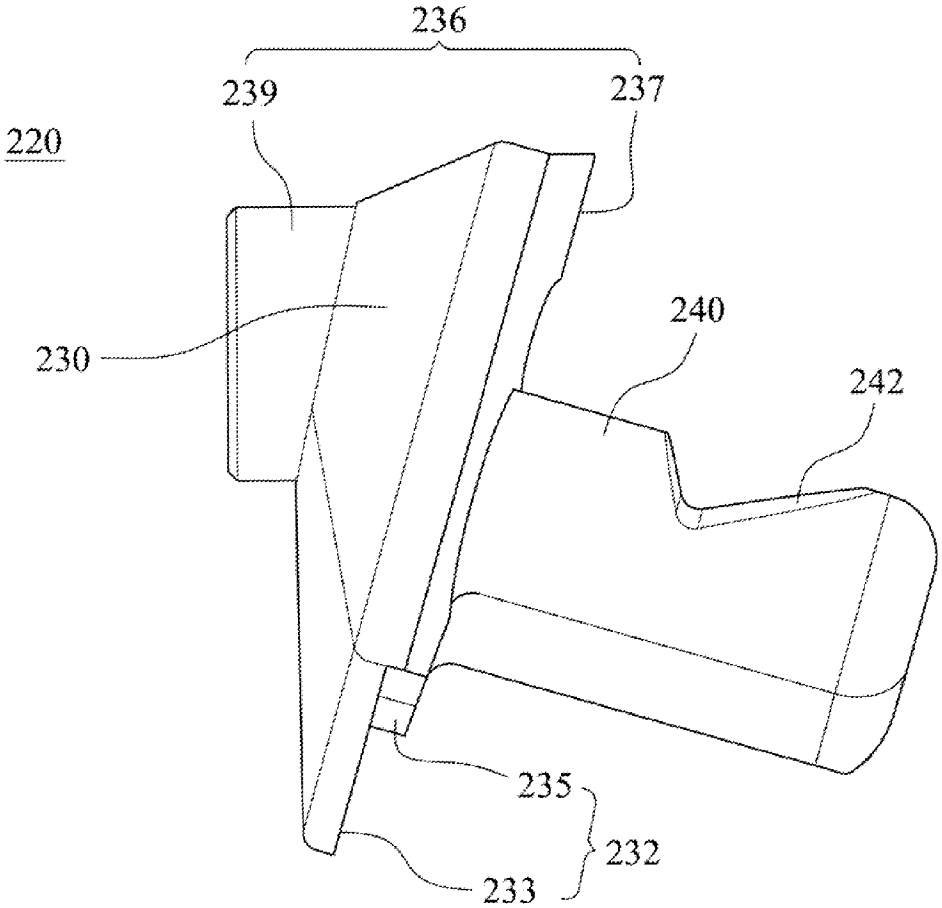
FIG. 7 is a side view of the holder according to the second embodiment of the present disclosure.
Figure 8:
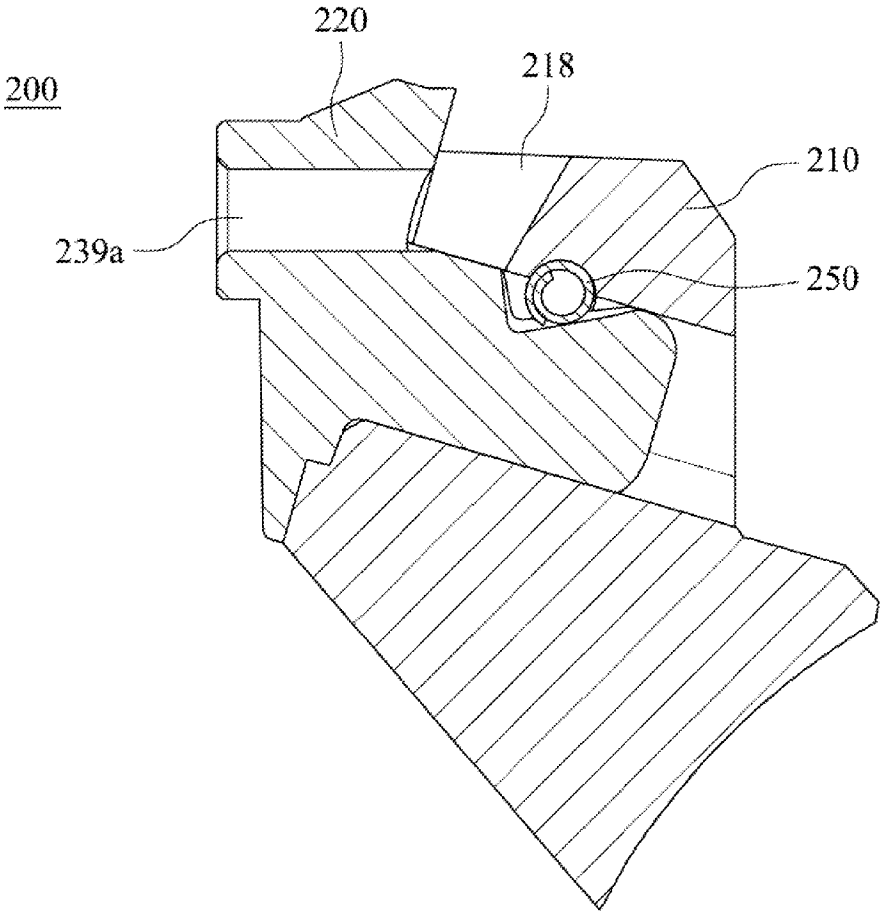
FIG. 8 is a cross-sectional view of the cutting tool holding device according to the second embodiment of the present disclosure.

FIG. 7 is a side view of the holder 220 according to the second embodiment of the present disclosure. FIG. 8 is a cross-sectional view of the cutting tool holding device 200 according to the second embodiment of the present disclosure. In FIGS. 7 and 8, the cutting tool holding device 200 includes the base 210, the holder 220, and fastening member 250. The holder 220 includes the main body 230 and the tool receiving corner post 240 with the position limiting grooves 242. The main body 230 includes the first abutting portion 232 and the second abutting portion 236. The first abutting portion 232 has the first abutting surface 233 and the engaging portion 235, and the second abutting portion 236 has the second abutting surface 237 and the mounting surface 239. The mounting surface 239 is located on the other side of the second abutting surface 237, and the mounting surface 239 has the holding hole **239*a* for holding the cutting tool B. The tool receiving corner post 240 extending projects from the main body 230 and is located between the first abutting surface 233 and the second abutting surface 237. The position of the tool receiving corner post 240 in the second embodiment is closer to the second abutting surface 237 compared to the tool receiving corner post 140 in the first embodiment. Therefore, the tool receiving corner post 240 does not have the second pushing hole, and the remove of the cutting tool B is by the first pushing hole 218 of the base 210 which is communicated with the holding hole 239*a***. The rest details of the second embodiment are the same as that shown in the first embodiment, and thus it is not illustrated any further.

Figure 9:
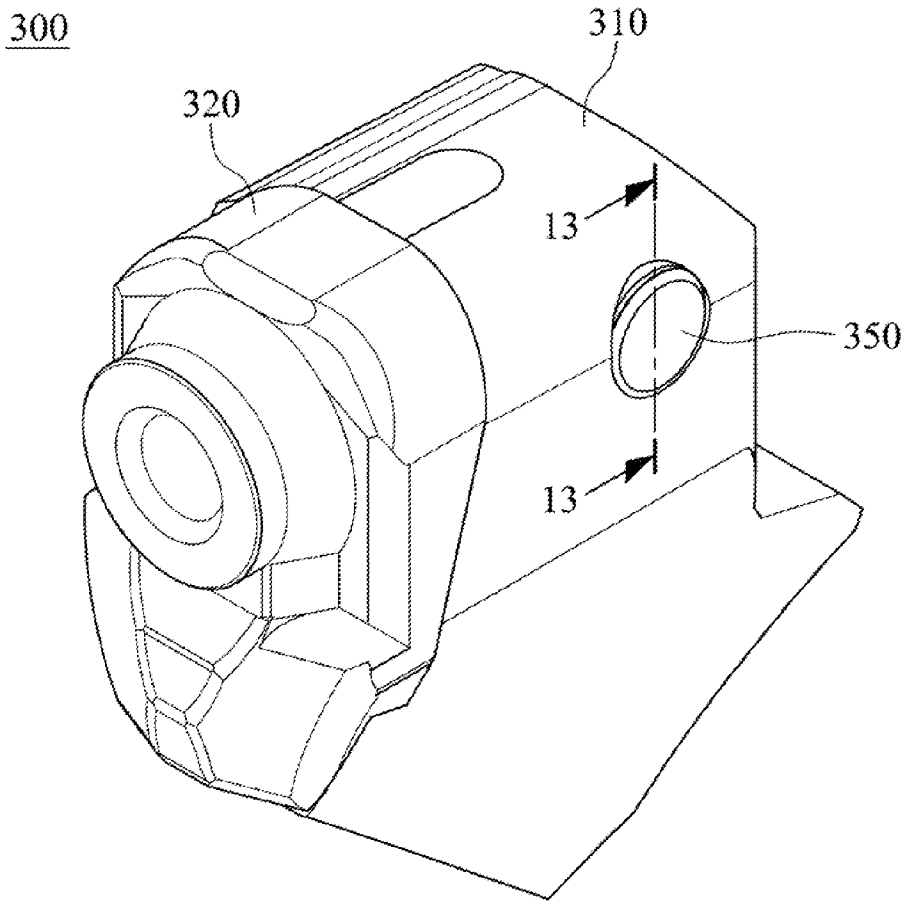
FIG. 9 is a perspective view of the cutting tool holding device according to the third embodiment of the present disclosure.
Figure 10:
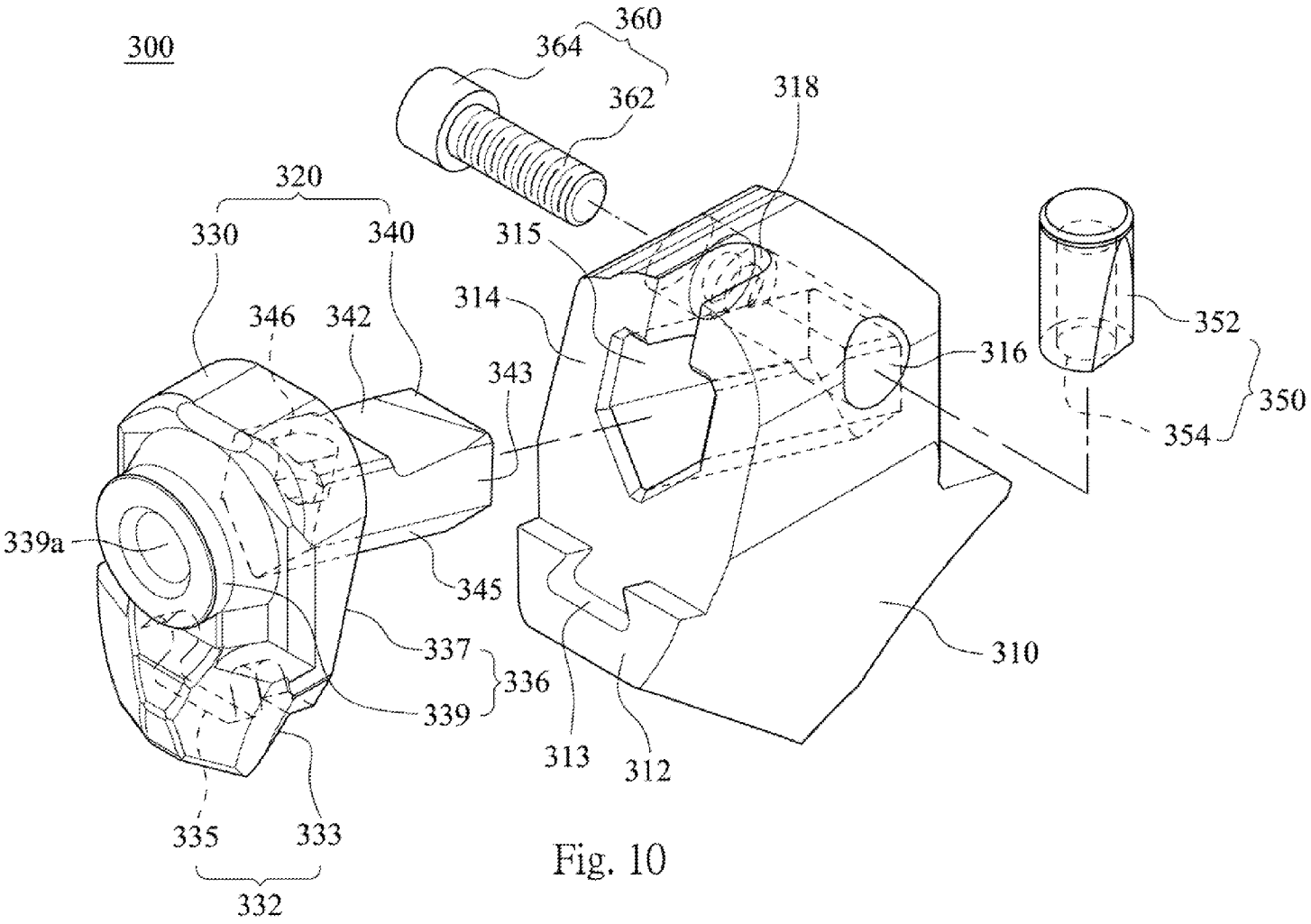
FIG. 10 is an exploded view of the cutting tool holding device shown in FIG. 9.

FIG. 9 is a perspective view of the cutting tool holding device 300 according to the third embodiment of the present disclosure. FIG. 10 is an exploded view of the cutting tool holding device 300 shown in FIG. 9. In FIGS. 9 and 10, the cutting tool holding device 300 includes the base 310, the holder 320, the fastening member 350, and the draw bolt member 360. The holder 320 is mounted on the base 310, and the fastening member 350 and the draw bolt member 360 are disposed in the base 310.

The base 310 includes the front rake wall 312, the back rake wall 314, the positioning hole 316, and the first pushing hole 318. The front rake wall 312 is connected to the back rake wall 314, wherein the front rake wall 312 has the rabbet 313 and the back rake wall 314 has an angular receiving hole 315. The angular receiving hole 315 has a central axis (not shown), wherein the central axis of the angular receiving hole 315 is paralleled to an extending direction of the rabbet 313. The positioning hole 316 is penetrated one end of the base 310 and communicated with the angular receiving hole 315. The positioning hole 316 has the central axis (not shown), wherein the central axis of the positioning hole 316 is perpendicular to an extending direction of the angular receiving hole 315. The first pushing hole 318 is formed on the other side of the base 310 and communicated with the angular receiving hole 315.

The holder 320 is mounted on the base 310 for receiving the cutting tool B, wherein the holder 320 includes the main body 330 and the tool receiving corner post 340.

The main body 330 includes the first abutting portion 332 and the second abutting portion 336. The first abutting portion 332 has the first abutting surface 333 and the engaging portion 335, wherein the first abutting surface 333 is abutted against the front rake wall 312, and the engaging portion 335 is detachably engaged into the rabbet 313. The second abutting portion 336 has the second abutting surface 337 and the mounting surface 339. The second abutting surface 337 is the flat surface and is fitting abutted against the back rake wall 314. The mounting surface 339 is located on the other side of the second abutting surface 337, and the mounting surface 339 has a holding hole **339*a* for holding the cutting tool B (as shown in FIG. 6**).

The tool receiving corner post 340 extending projects from the main body 330 and is correspondingly set into the angular receiving hole 315. The shape of the angular receiving hole 315 is complementary to the shape of the tool receiving corner post 340, so that the tool receiving corner post 340 does not move relative to the base 310 after setting into the angular receiving hole 315. The position limiting groove 342 is formed on the tool receiving corner post 340 corresponded with the positioning hole 316. The second pushing hole 346 is formed on the tool receiving corner post 340 near the main body 330, wherein the second pushing hole 346 is communicated with the holding hole **339*a* and the first pushing hole 318** for removing the cutting tool B.

The fastening member 350 is movably disposed in the positioning hole 316 and pressed against the position limiting groove 342, wherein a threaded hole 354 is formed in one end of the fastening member 350. In this embodiment, the threaded hole 354 is penetrated the fastening member 350 to form a through hole structure. In other embodiment, the threaded hole 354 can be not penetrated the fastening member 350. The fastening member 350 has n outer surface with a first inclined surface 352, thus a sectional area of the fastening member 350 gradually changes along the extending direction of the fastening member 350. Furthermore, the first inclined surface 352 presses the position limiting groove 342 of the tool receiving corner post 340.

The draw bolt member 360 is limitedly disposed in the positioning hole 316, wherein the draw bolt member 360 has a threading portion 362 and a stair portion 364 connected to the threading portion 362. The threading portion 362 of the draw bolt member 360 is screwed into the threaded hole 354 of the fastening member 350, whereby the draw bolt member 360 draws the fastening member 350 moving in the positioning hole to change a pressing extent between the fastening member 350 and the position limiting groove 342.

Figure 12:
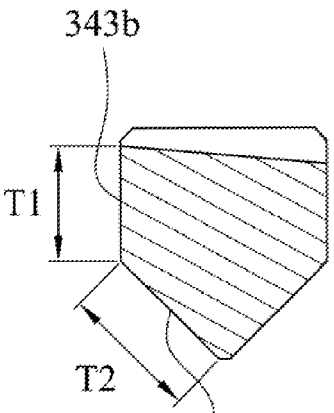
FIG. 12 is a partial cross-sectional view of the holder taken along line 12-12 of FIG. 11.
Figure 11:
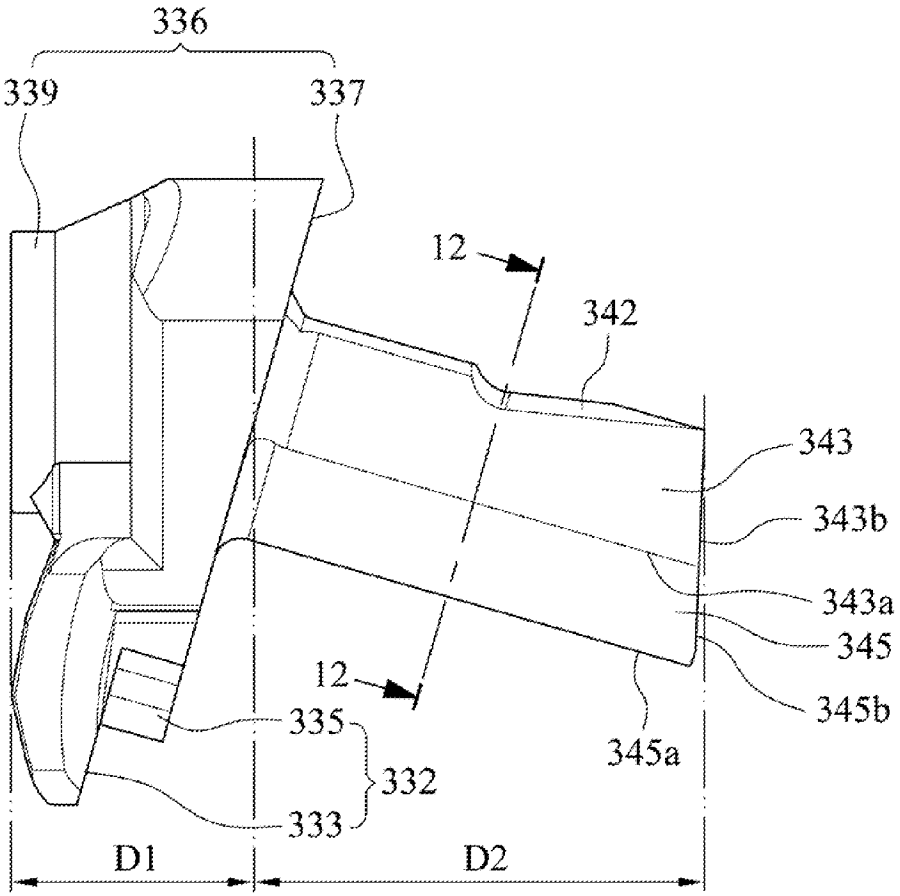
FIG. 11 is a side view of the holder shown in FIG. 9.

FIG. 11 is a side view of the holder 320 shown in FIG. 9. FIG. 12 is a partial cross-sectional view of the holder 320 taken along line 12-12 of FIG. 11. In FIGS. 11 and 12, the holder 320 has the central axis (not shown), and the thickness D1 of the main body 330 along the central axis is less than the thickness D2 of the tool receiving corner post 340 along the central axis. The tool receiving corner post 340 has at least two first side surfaces 343 and at least two second side surfaces 345. The first side surfaces 343 and the second side surfaces 345 are rectangular. Each of the first side surfaces 343 has the first adjacent side 343*a* and the first nonadjacent side 343*b*. Each of the second side surfaces 345 has the second adjacent side 345*a* and the second nonadjacent side 345*b*. Two first side surfaces 343 are paralleled to each other. Each of the second adjacent sides 345*a* on one side of the second side surface 345 adjoins the first adjacent side 343*a*, and the second adjacent sides 345*a* on the other side of the second side surfaces 345 approaches to each other to form a square pyramid. Furthermore, two second side surfaces 345 of the tool receiving corner post 340 are abutted against the base 310 along the force central axis (not shown) of the cutting tool holding device 300. The length T1 of the first nonadjacent side 343*b* is less than the length T2 of the second nonadjacent side 345*b*. The area of the second side surface 345 is greater than the area of the first side surface 343, and the second side surface 345 is abutted against the base 310 along the force central axis (not shown) of the cutting tool holding device 300. Therefore, the greater area of the second side surface 345 can enhance the stability of the engagement between the base 310 and the holder 320.

Figure 13:
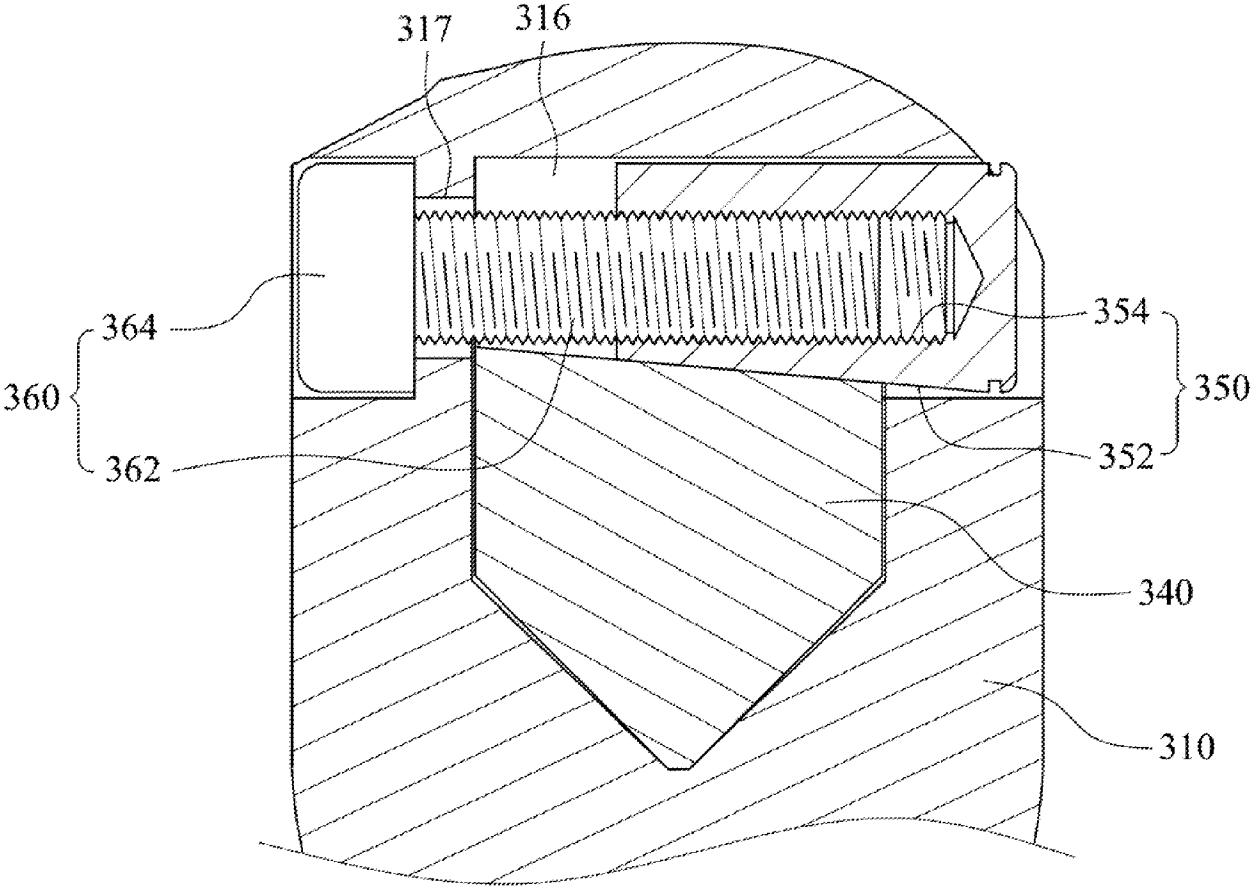
FIG. 13 is a partial cross-sectional view of the cutting tool holding device taken along line 13-13 of FIG. 9.

FIG. 13 is a partial cross-sectional view of the cutting tool holding device 300 taken along line 13-13 of FIG. 9. The positioning hole 316 of the base 310 has a first narrowed neck 317. The fastening member 350 is disposed at one end of the first narrowed neck 317, and the stair portion 364 of the draw bolt member 360 is disposed at the other end of the first narrowed neck 317. The threading portion 362 of the draw bolt member 360 passes through the first narrowed neck 317 to screw into the threaded hole 354 of the fastening member 350. A transverse cross-sectional area of the stair portion 364 is greater than the transverse cross-sectional area of the first narrowed neck 317 so that it can avoid the stair portion 364 moving to the other end of the first narrowed neck 317 therein in order to limit a position of the draw bolt member 360. In addition, the draw bolt member 360 draws the fastening member 350 moving in the positioning hole 316 to change a pressing extent between the fastening member 350 and the position limiting groove 342 by the threading portion 362 screwing into the threaded hole 354.

Figure 14:
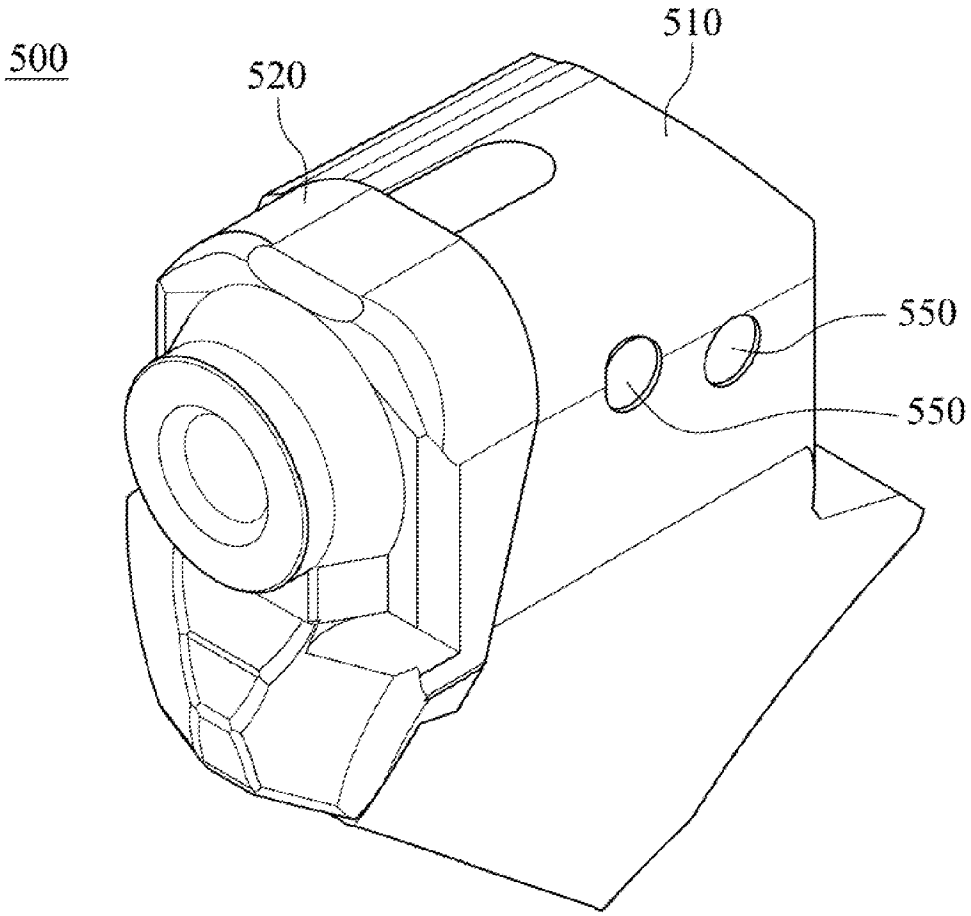
FIG. 14 is a perspective view of the cutting tool holding device according to the fourth embodiment of the present disclosure.
Figure 15:
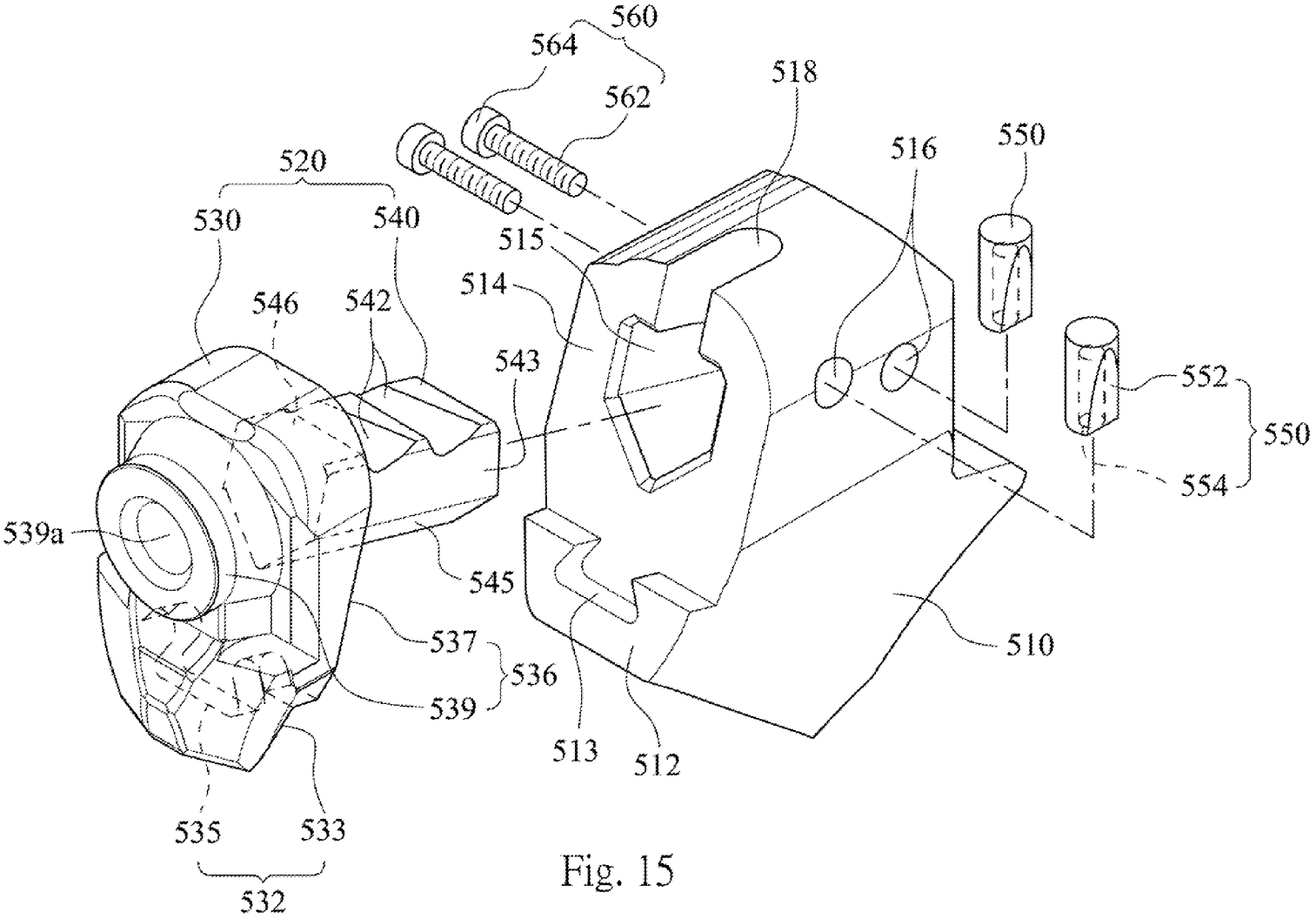
FIG. 15 is an exploded view of the cutting tool holding device shown in FIG. 14.

FIG. 14 is a perspective view of the cutting tool holding device 500 according to the fourth embodiment of the present disclosure. FIG. 15 is an exploded view of the cutting tool holding device 500 shown in FIG. 14. In FIGS. 14 and 15, the cutting tool holding device 500 includes the base 510, the holder 520, two fastening members 550, and two draw bolt members 560. The base 510 includes two positioning holes 516, and two positioning holes 516 are interval formed on the base 510. The holder 520 includes the main body 530 and the tool receiving corner post 540 with two position limiting grooves 542. Two fastening members 550 are respectively disposed in two positioning holes 516. Each of the fastening members 550 has the threaded hole 554 and the first inclined surface 552. Two draw bolt members 560 are limitedly disposed in the positioning holes 516 respectively, wherein each of the draw bolt members 560 has the threading portion 562 and the stair portion 564. Therefore, the stability of the engagement between the base 510 and the holder 520 can be improved by increasing a number of the fastening member 550 the draw bolt member 560, and the position limiting groove 542. The rest details of the fourth embodiment are the same as that shown in the third embodiment, and thus it is not illustrated any further.

According to the foregoing embodiment of the disclosure, the shape complementation between the angular receiving hole and the tool receiving corner post can avoid the rotation of the holder. The engagement between the engaging portion and the rabbet can fix the holder on the base. The draw bolt member draws the fastening member moving in the positioning hole to change the pressing extent between the base and the holder so that it can effectively avoid the engagement between the base and the holder being loose. Thus the present disclosure can enhance the stability of the engagement between the base and the holder and increase a load value of the base and the load value of the holder for the reaction force. The life span of the base and the holder can be prolonged, and the maintenance cost can be reduced. In addition, a user only need to spin the draw bolt member for precisely adjusting the pressing extent among the fastening member, the base, and the holder because the threading portion of the draw bolt member is screwed into the threaded hole of the fastening member. Therefore the present disclosure further has the advantages of easy operation and high accuracy of adjustment.

Although the present disclosure has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims.

What is claimed is:

1. A cutting tool holding device for holding a cutting tool, the cutting tool holding device comprising:

a base comprising:

a front rake wall having a rabbet;

a back rake wall connected to the front rake wall, wherein the back rake wall has an angular receiving hole; and a positioning hole penetrated one end of the base and communicated with the angular receiving hole;

a holder mounted on the base for receiving the cutting tool, wherein the holder comprises:

a main body comprising:

a first abutting portion having a first abutting surface and an engaging portion, wherein the first abutting surface is abutted against the front rake wall, and the engaging portion is detachably engaged into the rabbet; and a second abutting portion having a second abutting surface, wherein the second abutting surface is abutted against the back rake wall;

a tool receiving corner post extending projecting from the main body, wherein the tool receiving corner post is correspondingly set into the angular receiving hole, and a position limiting groove is formed on the tool receiving corner post corresponded with the positioning hole;

wherein the holder has a central axis, a thickness of the main body along the central axis is less than the thickness of the tool receiving corner post along the central axis, and a ratio of the thickness of the main body to the thickness of the cutting tool holding device is ⅓; and a fastening member fastened in the positioning hole and pressed against the position limiting groove.

2. The cutting tool holding device of claim 1, wherein the second abutting portion further comprises a mounting surface located on the other side of the second abutting surface, and the mounting surface has a holding hole communicated with the tool receiving corner post.

3. The cutting tool holding device of claim 2, wherein:

the base further comprises a first pushing hole formed on the base and communicated with the angular receiving hole; and the tool receiving corner post further comprises a second pushing hole, wherein the second pushing hole is communicated with the holding hole and the first pushing hole for removing the cutting tool.

4. The cutting tool holding device of claim 1, wherein the tool receiving corner post has:

at least two first side surfaces that are rectangular, and two first side surfaces paralleled to each other, wherein each of the first side surfaces has a first adjacent side and a first nonadjacent side; and at least two second side surfaces that are rectangular, wherein each of the second side surfaces has a second adjacent side and a second nonadjacent side;

wherein each of the second adjacent sides on one side of the second side surface adjoins the first adjacent side, and the second adjacent sides on the other side of the second side surfaces approaches to each other.

5. The cutting tool holding device of claim 4, wherein a length of the first nonadjacent side is less than the length of the second nonadjacent side.

6. The cutting tool holding device of claim 1, wherein the fastening member is a C-shaped elastic tube, and the fastening member is fastened in the positioning hole by an expanding elasticity thereof.

7. A cutting tool holding device for holding a cutting tool, the cutting tool holding device comprising:

a base comprising:

a front rake wall having a rabbet;

a back rake wall connected to the front rake wall, wherein the back rake wall has an angular receiving hole; and a positioning hole penetrated one end of the base and communicated with the angular receiving hole, wherein the positioning hole has a first narrowed neck;

a holder mounted on the base for receiving the cutting tool, wherein the holder comprises:

a main body comprising:

a first abutting portion having a first abutting surface and an engaging portion, wherein the first abutting surface is abutted against the front rake wall, and the engaging portion is detachably engaged into the rabbet; and a second abutting portion having a second abutting surface, wherein the second abutting surface is abutted against the back rake wall;

a tool receiving corner post extending projecting from the main body, wherein the tool receiving corner post is correspondingly set into the angular receiving hole, and a position limiting groove is formed on the tool receiving corner post corresponded with the positioning hole;

a fastening member movably disposed in the positioning hole and at one end of the first narrowed neck and pressed against the position limiting groove, wherein a threaded hole is formed in one end of the fastening member, and a sectional area of the fastening member gradually changes along an extending direction of the fastening member; and a draw bolt member limitedly disposed in the positioning hole, wherein the draw bolt member has a threading portion for screwing into the threaded hole, whereby the draw bolt member draws the fastening member moving in the positioning hole to change a pressing extent between the fastening member and the position limiting groove;

wherein the draw bolt member comprises a stair portion connected to the threading portion, a transverse cross-sectional area of the stair portion is greater than the transverse cross-sectional area of the first narrowed neck, the stair portion is disposed at the other end of the first narrowed neck, and the threading portion passes through the first narrowed neck to screw into the threaded hole of the fastening member.

8. The cutting tool holding device of claim 7, wherein the second abutting portion further comprises a mounting surface located on the other side of the second abutting surface, and the mounting surface has a holding hole communicated with the tool receiving corner post.

9. The cutting tool holding device of claim 8, wherein:

the base further comprises a first pushing hole formed on the base and communicated with the angular receiving hole; and the tool receiving corner post further comprises a second pushing hole, wherein the second pushing hole is communicated with the holding hole and the first pushing hole for removing the cutting tool.

10. The cutting tool holding device of claim 7, wherein the tool receiving corner post comprises:

at least two first side surfaces that are rectangular, and two first side surfaces paralleled to each other, wherein each of the first side surfaces has a first adjacent side and a first nonadjacent side; and at least two second side surfaces that are rectangular, wherein each of the second side surfaces has a second adjacent side and a second nonadjacent side;

wherein each of the second adjacent sides on one side of the second side surface adjoins the first adjacent side, and the second adjacent sides on the other side of the second side surfaces approaches to each other.

11. The cutting tool holding device of claim 10, wherein a length of the first nonadjacent side is less than the length of the second nonadjacent side.

12. The cutting tool holding device of claim 7, wherein the holder has a central axis, and a thickness of the main body along the central axis is less than the thickness of the tool receiving corner post along the central axis.

13. The cutting tool holding device of claim 12, a ratio of the thickness of the main body to the thickness of the cutting tool holding device is ⅓.

14. The cutting tool holding device of claim 7, wherein fastening member has an outer surface with a first inclined surface, and the first inclined surface presses the position limiting groove of the tool receiving corner post.

* * * * *